US007446640B2

(12) United States Patent
Saito et al.

(10) Patent No.: US 7,446,640 B2
(45) Date of Patent: Nov. 4, 2008

(54) LEAKAGE TRANSFORMER

(75) Inventors: Masaki Saito, Tokyo (JP); Hiroki Miura, Tokyo (JP)

(73) Assignee: Sumida Corporation, Tokyo (JP)

( * ) Notice: Subject to any disclaimer, the term of this patent is extended or adjusted under 35 U.S.C. 154(b) by 61 days.

(21) Appl. No.: 11/574,352

(22) PCT Filed: Jul. 12, 2005

(86) PCT No.: PCT/JP2005/012838

§ 371 (c)(1),
(2), (4) Date: Feb. 27, 2007

(87) PCT Pub. No.: WO2006/025156

PCT Pub. Date: Mar. 9, 2006

(65) Prior Publication Data

US 2007/0257760 A1 Nov. 8, 2007

(30) Foreign Application Priority Data

Sep. 1, 2004 (JP) ..... 2004-254230

(51) Int. Cl.
*H01F 27/24* (2006.01)

(52) U.S. Cl. ..... 336/212

(58) Field of Classification Search ..... 336/65, 336/83, 180–182, 200, 212, 220–223, 214, 336/215

See application file for complete search history.

(56) References Cited

U.S. PATENT DOCUMENTS 6,278,620 B1 * 8/2001 Yasumura ..... 363/19

FOREIGN PATENT DOCUMENTS

| | | |
|---|---|---|
| JP | 56-4220 A | 1/1981 |
| JP | 56-112919 | 9/1981 |
| JP | 2000-195731 A | 7/2000 |
| JP | 2002-100517 A | 4/2002 |

* cited by examiner

*Primary Examiner*—Tuyen T. Nguyen
(74) *Attorney, Agent, or Firm*—Mark Montague; Cowan, Liebowitz & Latman, P.C.

(57) ABSTRACT

A leakage transformer includes a primary winding; a secondary winding wound at a part on an extension of a winding part of the primary winding separately from the primary winding and having a coil sectional area smaller than that of the primary winding; a center core part composed of two core members and linearly extending through the primary winding and the secondary winding; and a peripheral core part formed by extending part of the two core members at the center core part and forming a magnetic path on the outer side of the primary winding and the secondary winding.

4 Claims, 10 Drawing Sheets

LEAKAGE TRANSFORMER

TECHNICAL FIELD

The present invention relates to a leakage transformer for use, for example, in an inverter circuit.

BACKGROUND ART

Conventionally, a leakage transformer has been used, for example, as a booster transformer of an inverter circuit for the backlight of a liquid crystal display panel.

In many cases, the casing of a liquid crystal display device, a small-sized computer or the like with a built-in liquid crystal display panel is designed to be small and thin so as not to interfere with space saving. Thus, any device used in the casing of such an apparatus, such as a transformer, is required to be thin and/or narrow.

An example of such a narrow type leakage transformer uses an I-shaped core as the center core extending through the primary and secondary windings and a U-shaped core as the external magnetic path (see, for example, Patent Document 1).

Patent Document 1: JP 2004-31647 A (Abstract, etc.)

OBJECTS OF THE INVENTION

In the case of the above-mentioned leakage transformer using a U-shaped core and an I-shaped core, while it is possible to obtain a sufficient leakage inductance due to a leakage magnetic flux free from interlinkage with the secondary winding, there is also generated a magnetic flux leakage to the exterior of the leakage transformer.

It is accordingly an object of the present invention to provide a leakage transformer making it possible to secure a sufficient leakage inductance while reducing the magnetic flux leakage to the exterior.

SUMMARY OF THE INVENTION

To solve the above-mentioned problem, the present invention adopts the following arrangement.

A leakage transformer according to the present invention includes a primary winding; a secondary winding wound at a part on an extension of a winding part of the primary winding separately from the primary winding and having a coil sectional area smaller than that of the primary winding; a center core part composed of two core members and linearly extending through the primary winding and the secondary winding; and a peripheral core part formed by extending parts of the two core members at the center core part and forming a magnetic path on the outer side of the primary winding and the secondary winding.

With this arrangement, it is possible to secure a sufficient leakage inductance by making the coil sectional area of the primary winding larger than the coil sectional area of the secondary winding while reducing the magnetic flux leakage to the exterior by means of the peripheral core part.

Further, in addition to the above-mentioned leakage transformer arrangement, the leakage transformer of the present invention may also adopt the following arrangement: the center core part may be formed such that the sectional area of the portion thereof corresponding to at least a part of the primary winding is larger than the sectional area of the portion thereof corresponding to the secondary winding.

This makes it possible to further enlarge the leakage magnetic flux not undergoing interlinkage with the secondary winding while reducing the magnetic flux leakage to the exterior by means of the peripheral core part to thereby easily secure a sufficient leakage inductance.

Further, in addition to one of the above-mentioned leakage transformer arrangements, the leakage transformer of the present invention may also be equipped with a leakage core part which extends, of the primary and secondary windings, exclusively through the primary winding.

This makes it possible to further enlarge the leakage magnetic flux not undergoing interlinkage with the secondary winding while reducing the magnetic flux leakage to the exterior by means of the peripheral core part to thereby easily secure a sufficient leakage inductance.

Further, in addition to one of the above-mentioned leakage transformer arrangements, the leakage transformer of the present invention may also adopt a construction in which the peripheral core part is composed of a plurality of members having a bonding portion, with the plurality of members forming cutout portions at the bonding portion.

With this construction, the cutout portions constitute adhesive accumulating places when bonding the plurality of members, making it possible to retain surplus adhesive squeezed out of the bonding portion of the peripheral core part.

A leakage transformer according to the present invention includes a first core having at least three extending parts; a second core having at least three extending parts, of which two outermost extending parts are connected to two outermost extending parts of the first core; a primary winding wound, in a first coil sectional area, around extending parts which are opposed to each other and which are other than the outermost ones of at least one of the first core and the second core; and a secondary winding wound, in a second coil sectional area smaller than the first coil sectional area, around at least one of the extending parts around which the primary winding is wound and the extending parts opposed to the extending parts around which the primary winding is wound.

With this construction, it is possible to secure a sufficient leakage inductance by making the coil sectional area of the primary winding larger than the coil sectional area of the secondary winding while reducing the magnetic flux leakage to the exterior by means of the two outermost extending parts of each of the first and second cores.

Further, in addition to the above-mentioned leakage transformer arrangement, the leakage transformer of the present invention may also be equipped with an upper surface core connected to the upper surfaces of the first core and the second core and covering the primary winding and the secondary winding.

With this construction, due to the upper surface core provided in addition to the two external extending parts, it is possible to secure a sufficient leakage inductance while further reducing the magnetic flux leakage to the exterior by means of the upper surface core. Further, when placing the leakage transformer on a board by means of a mounting machine, the upper surface core is attracted to the mounting machine, whereby it is possible to place the leakage transformer on the board without using any separate member for attraction.

Further, in addition to one of the above-mentioned leakage transformer arrangements, the leakage transformer of the present invention may adopt a construction in which the two outermost extending parts of each of the first core and the second core have cutout portions at a bonding portion between the first core and the second core.

With this construction, the cutout portions constitute adhesive accumulating places when bonding the first core and the second core to each other, making it possible to retain surplus adhesive squeezed out of the bonding portion between the first core and the second core.

A leakage transformer according to the present invention includes a first E-shaped core; a second E-shaped core of which two outer extending parts other than a central extending part are connected to two outer extending parts of the first E-shaped core; a primary winding wound, in a first coil sectional area, around the central extending part of at least one of the first and second E-shaped cores; and a secondary winding wound, in a second coil sectional area smaller than the first coil sectional area, around the central extending part of at least one of the first and second E-shaped cores.

With this construction, it is possible to secure a sufficient leakage inductance by making the coil sectional area of the primary winding larger than the coil sectional area of the secondary winding while reducing the magnetic flux leakage to the exterior by means of the two outer extending parts of each of the two E-shaped cores.

Further, in addition to the above-mentioned leakage transformer arrangement, the leakage transformer of the present invention may adopt a construction in which the two outer extending parts of the first E-shaped core and the second E-shaped core have cutout portions at a bonding portion between the first E-shaped core and the second E-shaped core.

With this construction, the cutout portions constitute adhesive accumulating places when bonding together the first E-shaped core and the second E-shaped core, making it possible to retain surplus adhesive squeezed out of the bonding portion between the first E-shaped core and the second E-shaped core.

According to the present invention, in the leakage transformer, it is possible to reduce the magnetic flux leakage to the exterior while securing a sufficient leakage inductance.

DETAILED DESCRIPTION OF THE INVENTION

In the following, embodiments of the present invention will be described with reference to the drawings.

Embodiment 1

Figure 1:
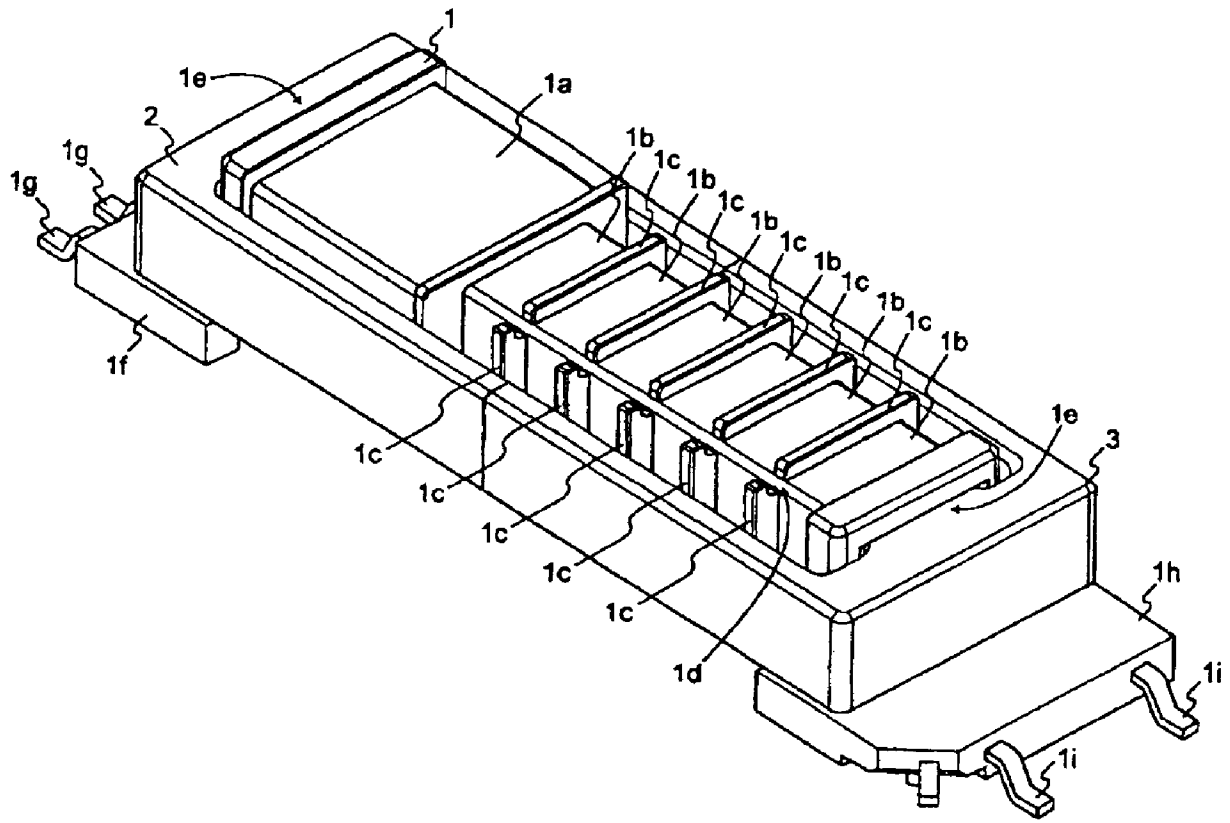
FIG. 1 is a perspective view of a leakage transformer according to Embodiment 1 of the present invention.

FIG. 1 is a perspective view of a leakage transformer according to Embodiment 1 of the present invention. In FIG. 1, a support member 1 is a member formed by integrating with each other bobbin portions 1*a* and 1*b* for a primary winding and a secondary winding, respectively, and base portions 1*f* and 1*h*, and is adapted to support cores 2 and 3. Except for terminal members 1*g* and 1*i*, the support member 1 is formed of a non-magnetic insulating material.

In the support member 1, the bobbins 1*a* and 1*b* are formed as box-shaped tube. The bobbin portion 1*a* has flanges at both ends, and the primary winding is wound therearound; a series of bobbin portions 1*b* has flange portions 1*c* arranged at fixed intervals, and the secondary winding is wound therearound. Each flange 1*c* is equipped with a cutout 1*d* for laying the secondary winding when winding the secondary winding continuously between two adjacent bobbin portions 1*b*. In FIG. 1, the primary winding and the secondary winding are omitted. Since this leakage transformer is a kind of booster transformer, the voltage induced in the secondary winding is higher than that induced in the primary winding. Thus, to prevent dielectric breakdown in the portions where the secondary winding is wound, the secondary winding is wound sequentially and in series around the bobbin portions 1*b* partitioned by the flange portions 1*c*. That is, only a voltage not higher than a fixed voltage is induced in the portion of the secondary winding wound around each bobbin portion 1*b*.

Further, each of the bobbin portions 1*a* and 1*b* is formed in a predetermined thickness, so a through-hole 1*e* is formed inside of the bobbin portions 1*a* and 1*b*. The through-hole 1*e* has an opening area large enough to allow insertion of the cores 2 and 3 from both openings thereof.

The base portion 1*f* of the support member 1 is formed as a flat plate, and has the terminal members 1*g* to which the terminals of the primary winding are electrically connected. The terminal members 1*g* are formed of metal, and are integrated with the base portion 1*f* through insert molding or the like. The base portion 1*h* of the support member 1 is formed as a flat plate, and has the terminal members 1*i* to which the terminals of the secondary winding are electrically connected. The terminal members 1*i* are formed of metal, and are integrated with the base portion 1*h* through insert molding or the like.

The cores 2 and 3 are E-shaped cores formed of a magnetic material such as ferrite. The core 2 is a first core arranged on the primary winding side, and the core 3 is a second core arranged on the secondary winding side. Central extending parts of the cores 2 and 3 are inserted into the through-hole 1*e*, and two outer extending parts of each of the cores are bonded together, whereby the cores 2 and 3 are fixed to the support member 1. Windings 4 and 5 are wound around the support member 1, and the terminals thereof are connected to the terminal members 1*g* and 1*i* before attaching the cores 2 and 3 to the support member 1.

Figure 2:
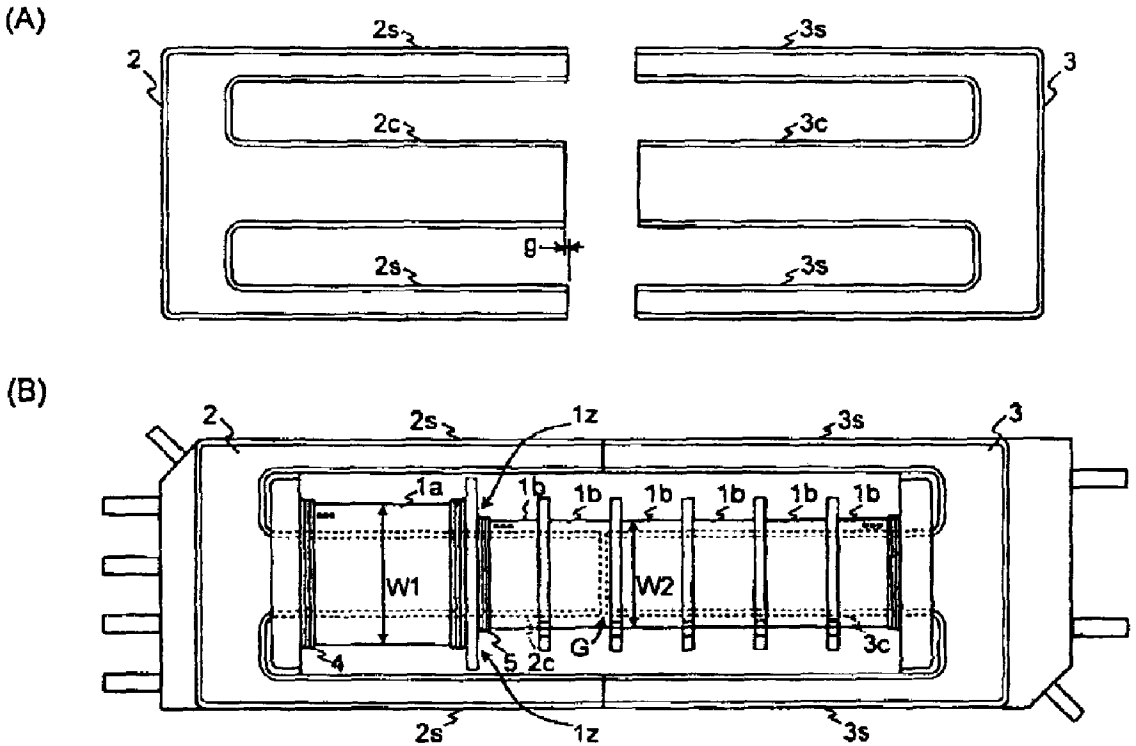
FIG. 2 is a diagram showing the positional relationship between a support member, cores, a primary winding, a secondary winding, etc. in Embodiment 1.

FIG. 2 is a diagram showing the positional relationship between the support member 1, the cores 2 and 3, the primary winding 4, the secondary winding 5, etc. in Embodiment 1. FIG. 2(A) is top view of the cores 2 and 3, and FIG. 2(B) is a plan view of the leakage transformer of Embodiment 1.

As shown in FIG. 2(A), in Embodiment 1, the cores 2 and 3 have the same configuration. Each of the cores 2 and 3 has central extending parts 2*c* and 3*c* and pairs of extending parts 2*s* and 3*s*. The three extending parts 2*c* and 2*s* extend in the same direction, and are formed integrally as one core 2. Similarly, the three extending parts 3*c* and 3*s* extend in the same direction, and are formed integrally as one core 3. The sectional area of the extending parts 2s (3s) (sectional area taken in a direction perpendicular to extending direction) is substantially half the sectional area of extending part 2c (3c).

Further, the central extending part 2c (3c) is formed to be shorter than the outer extending parts 2s (3s) by a length g. As a result, as shown in FIG. 2(B), when the distal ends of the extending parts 2s of the core 2 and the distal ends of the extending parts 3s of the core 3 are caused to abut each other, a gap (clearance) G having a length of 2g is formed between the extending part 2c of the core 2 and the extending part 3c of the core 3.

On the other hand, the primary winding 4 is wound around the bobbin portion 1a, and the secondary winding 5 is wound around the bobbin portions 1b. That is, the primary winding 4 is wound around the extending part 2c of the core 2, and the secondary winding 5 is wound around the extending part 2c of the core 2 and the extending part 3c of the core 3. Here, the coil sectional area of the primary winding 4 is the product of a width W1 of the bobbin portion 1a and a height ha of the bobbin portion 1a, and the coil sectional area of the secondary winding 5 is the product of a width W2 of the bobbin portions 1b and a height hb of the bobbin portions 1b. The coil sectional area of the primary winding 4 is designed to be larger than the coil sectional area of the secondary winding 5. In Embodiment 1, the heights ha and hb of the bobbin portions 1a and 1b are substantially the same, and the width W1 of the bobbin portion 1a is designed to be larger than the width W2 of the bobbin portions 1b, so the coil sectional area of the primary winding 4 is larger than the coil sectional area of the secondary winding 5.

Further, while the primary winding 4 and the secondary winding 5 are separately wound around the bobbin portion 1a and the bobbin portions 1b, since the bobbin portion 1a and the bobbin portions 1b are provided adjacent to each other, the coil opening of the primary winding 4 and the coil opening of the secondary winding 5 are close to each other. Further, since the coil sectional area of the secondary winding 5 is smaller than the coil sectional area of the primary winding 4, a part of the coil opening of the primary winding 4 corresponding to a step portion 1z between the bobbin portion 1a and the bobbin portions 1b is situated on the outer side with respect to the central axis of the secondary winding 5, and constitutes a magnetic leakage port. A part of the magnetic flux passing through this leakage port does not pass through the coil section of the secondary winding 5 but passes through the intervals (i.e., clearances) between the leakage port and the extending parts 2s of the core 2.

Next, the magnetic characteristics of the above-mentioned leakage transformer will be illustrated.

The extending parts 2c and 3c of the two cores 2 and 3 form a center core part extending linearly through the primary winding 4 and the secondary winding 5. This center core part is provided with the gap G. Further, the extending parts 2s and 3s of the two cores 2 and 3 form a peripheral core part constituting the external magnetic path of the primary winding 4 and the secondary winding 5. That is, the boundaries between the center core part and the peripheral core part (boundary portions between the ends of the center core part and ends of the peripheral core part) are within the cores 2 and 3, with the two being continuous without the presence of any bonding portion or gap.

In Embodiment 1, the cores 2 and 3 are E-shaped, so two peripheral core parts are formed on both sides of the center core part. Then, the single center core part and the two peripheral core parts form a circuiting magnetic path (magnetic path including the gap G).

In this magnetic construction, most of the magnetic fluxes generated by the primary winding 4 circuit through the center core part (extending parts 2c and 3c) and the peripheral core parts (extending parts 2s and 3s) to undergo interlinkage with the secondary winding 5.

On the other hand, among the magnetic fluxes generated by the primary winding 4, there exists a first leakage magnetic flux passing through a route directly connecting the magnetic leakage port corresponding to the step portion 1z and the extending parts 2s of the core 2 and not undergoing interlinkage with the secondary winding 5. Further, among the magnetic fluxes generated by the primary winding 4, there also exists a second leakage magnetic flux leaking through the gap G and circuiting without undergoing interlinkage with a part of the secondary winding 5.

In terms of electric circuit, those leakage magnetic fluxes act as the leakage inductance of the transformer. In the leakage transformer of Embodiment 1, there exists the first leakage magnetic flux in addition to the second leakage magnetic flux, so the leakage magnetic flux amount is large, making it possible to attain a sufficiently high leakage inductance value. In addition, the first and second leakage magnetic fluxes can easily pass through the extending parts 2s and 3s on the outer sides of the cores 2 and 3, so the amount of leakage magnetic fluxes to the exterior of the transformer is advantageously small.

As described above, the leakage transformer of Embodiment 1 is equipped with the primary winding 4, the secondary winding 5 wound at a part on the extension of the winding part of the primary winding 4 separately from the primary winding 4 and having a coil sectional area smaller than the coil sectional area of the primary winding 4, the center core part composed of the two cores 2 and 3 and linearly extending through the primary winding 4 and the secondary winding 5, and the peripheral core parts formed by the extending parts of the two cores 2 and 3 of the center core part and forming magnetic paths on the outer sides of the primary winding 4 and the secondary winding 5.

In this construction, it is possible to secure a sufficient leakage inductance by making the coil sectional area of the primary winding 4 larger than the coil sectional area of the secondary winding 5 while reducing the magnetic flux leakage to the exterior by means of the peripheral core part.

Further, in Embodiment 1, E-shaped cores of the same configuration are used as the two cores 2 and 3, so it is possible to reduce the production cost of the cores 2 and 3.

Embodiment 2

In a leakage transformer according to Embodiment 2 of the present invention, one core 2 of the leakage transformer of Embodiment 1 is modified.

Figure 3:
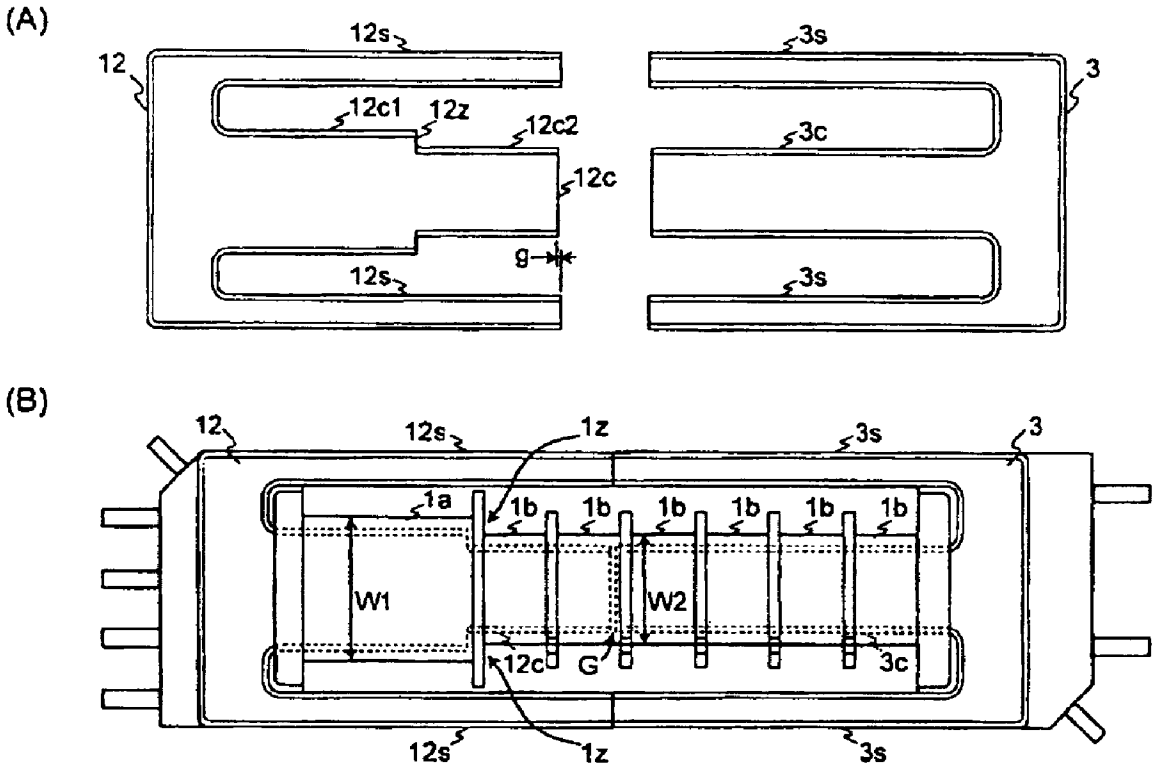
FIG. 3 is a diagram showing the core configuration and the positional relationship between a support member, cores, etc. in a leakage transformer according to Embodiment 2.

FIG. 3 is a diagram showing the configurations of the cores 12 and 3 and the positional relationship between the support member 1, the cores 12 and 3, etc. in the leakage transformer of Embodiment 2 of the present invention. FIG. 3(A) is a plan view of the cores 12 and 3, and FIG. 3(B) is a plan view of the leakage transformer of Embodiment 2.

As shown in FIG. 3, the leakage transformer of Embodiment 2 has the core 12 and the core 3. The core 3 is the same as that of Embodiment 1.

In Embodiment 2, the cores 12 and 3 have different configurations. Except for the central extending part 12c, the core 12 has the same configuration as the core 2. The extending part 12c of the core 12 has two portions 12c1 and 12c2 whose sectional areas taken in a direction perpendicular to the extending direction are different from each other. The portion

12*c*1 on the proximal side has a sectional area larger than the sectional area of the extending part 3*c* of the core 3, and the portion 12*c*2 on the distal side has a sectional area that is the same as the sectional area of the extending part 3*c* of the core 3.

The extending part 12*c* is formed to be shorter than the other extending parts 12*c* by a length g. As a result, as shown in FIG. 3(B), when the distal ends of the extending parts 12*s* of the core 12 and the distal ends of the extending parts 3*s* of the core 3 are caused to abut each other, there is formed a gap (clearance) G of a length 2*g* between the extending part 12*c* of the core 12 and the extending part 3*c* of the core 3.

When the extending part 12*c* is inserted into the through-hole 1*e*, the proximal portion 12*c*1 of the extending part 12*c* is arranged on the inner side of the bobbin portion 1*a* (that is, primary winding), and the distal portion 12*c*2 thereof is arranged on the inner side of the bobbin portions 1*b* (that is, secondary winding). Further, the extending part 12*c* has a step portion 12*z* between the proximal portion 12*c*1 and the distal portion 12*c*2; when the extending part 12*c* is inserted into the through-hole 1*e*, the step portion 12*z* is arranged close to the step portion 1*z* between the bobbin portion 1*a* and the bobbin portions 1*b*.

Otherwise, the leakage transformer of Embodiment 2 is of the same construction as that of Embodiment 1, so a description thereof will be omitted.

Next, the magnetic characteristics of the above-mentioned leakage transformer will be illustrated.

The extending parts 12*c* and 3*c* of the two cores 12 and 3 form a center core part extending linearly through the primary winding and the secondary winding. This center core part is provided with the gap G. Further, the extending parts 12*s* and 3*s* of the two cores 12 and 3 form a peripheral core part constituting the external magnetic path of the primary winding and the secondary winding. That is, the boundaries between the center core part and the peripheral core part are within the cores 12 and 3, with the two being continuous without the presence of any bonding portion or gap.

In Embodiment 2, the cores 12 and 3 are E-shaped, so two peripheral core parts are formed on both sides of the center core part. The single center core part and the two peripheral core parts form a circuiting magnetic path (magnetic path including the gap G).

In this magnetic construction, most of the magnetic fluxes generated by the primary winding circuit through the center core part (extending parts 12*c* and 3*c*) and the peripheral core parts (extending parts 12*s* and 3*s*) to undergo interlinkage with the secondary winding.

On the other hand, among the magnetic fluxes generated by the primary winding, there exists a first leakage magnetic flux passing through a route directly connecting the magnetic leakage port corresponding to the step portion 1*z* and 12*z* and the extending parts 12*s* of the core 12 and not undergoing interlinkage with the secondary winding. Further, among the magnetic fluxes generated by the primary winding, there also exists a second leakage magnetic flux leaking through the gap G and circuiting without undergoing interlinkage with a part of the secondary winding.

As in Embodiment 1, due to those leakage magnetic fluxes, also in the leakage transformer of Embodiment 2, it is possible to attain a sufficiently high inductance value. Further, as in Embodiment 1, also in the leakage transformer of Embodiment 2, the magnetic flux leakage to the exterior of the transformer occurs advantageously to a small degree.

As described above, according to Embodiment 2, the center core part is formed such that the sectional area of the portion thereof corresponding to at least a part of the primary winding (here, proximal portion 12*c*1 of the extending part 12*c*) is larger than the sectional area of the portion thereof corresponding to the secondary winding (that is, sectional area of the distal portion 12*c*2 of the extending part 12*c* and the extending part 3*c*).

With this construction, it is possible to further enlarge the leakage magnetic flux not undergoing interlinkage with the secondary winding 5 while reducing the magnetic flux leakage to the exterior by means of the peripheral core parts, making it possible to easily secure a sufficient leakage inductance.

Embodiment 3

A leakage transformer according to Embodiment 3 of the present invention is equipped with a leakage core part which does not extend through the secondary winding but extends solely through the primary winding.

Figure 4:
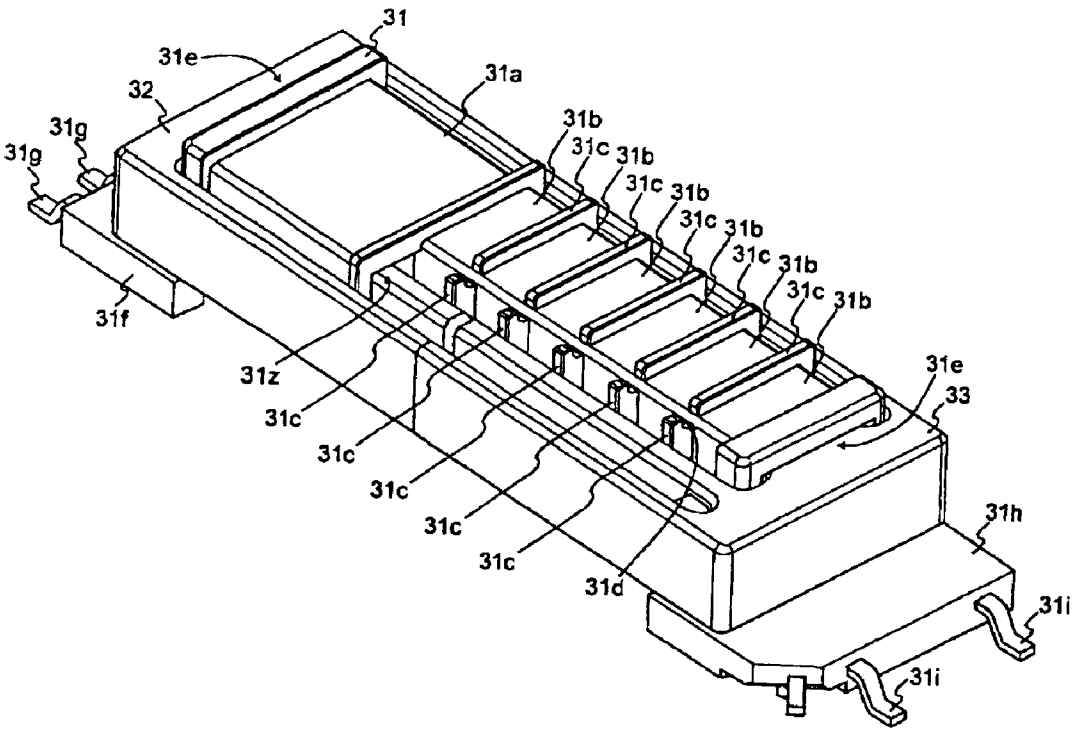
FIG. 4 is a perspective view of a leakage transformer according to Embodiment 3 of the present invention.

FIG. 4 is a perspective view of a leakage transformer according to Embodiment 3 of the present invention. In FIG. 4, a support member 31 is a member formed by integrating with each other bobbin portions 31*a* and 31*b* for a primary winding and a secondary winding, and base portions 31*f* and 31*h*, and is adapted to support cores 32 and 33. Except for terminal members 31*g* and 31*i*, the support member 31 is formed of a non-magnetic insulating material.

In the support member 31, the bobbins 31*a* and 31*b* are formed as box-shaped tube. The bobbin portion 31*a* has flanges at both ends, and the primary winding is wound therearound; a series of bobbin portions 31*b* has flange portions 31*c* arranged at fixed intervals, and the secondary winding is wound therearound. Each flange 1*c* is equipped with a cutout 31*d* for laying the secondary winding when winding the secondary winding continuously between two adjacent bobbin portions 31*b*. In FIG. 4, the primary winding and the secondary winding are omitted. As in Embodiment 1, the secondary winding is wound sequentially and in series around the bobbin portions 31*b* partitioned by the flange portions 31*c*.

Further, each of the bobbin portions 31*a* and 31*b* is formed in a predetermined thickness, so a through-hole 31*e* is formed inside of the bobbin portions 31*a* and 31*b*. The through-hole 31*e* has an opening area large enough to allow insertion of the cores 32 and 33 from both openings thereof. Further, in the boundary portion between the bobbin portion 31*a* and the bobbin portions 31*b*, there is formed an opening 31*z*. As shown in FIG. 4, the opening 31*z* is formed in a size allowing insertion of the core portion passing solely through the primary winding.

The base portion 31*f* of the support member 31 is formed as a flat plate, and has the terminal members 31*g* to which the terminals of the primary winding are electrically connected. The base portion 31*h* is formed as a flat plate, and has the terminal members 31*i* to which the terminals of the secondary winding are electrically connected. The terminal members 31*g* and 31*i* are the same as the terminal members 1*g* and 1*i* of Embodiment 1.

The cores 32 and 33 are cores formed of a magnetic material such as ferrite and having four extending parts. The core 32 is a first core arranged on the primary winding side, and the core 33 is a second core arranged on the secondary winding side. One of the extending parts of the core 32 and 33 other than the two on the outer sides is inserted into the through-hole 31*e*, and another extending part of the core 32 other than the two on the outer sides is inserted into the opening 31*z*; further, the outer two extending parts are bonded together, whereby the cores 32 and 33 are fixed to the support member 31. The primary winding and the secondary winding are wound around the support member 31, and the terminals thereof are connected to the terminal members 31*g* and 31*i* before attaching the cores 32 and 33 to the support member 31.

Figure 5:
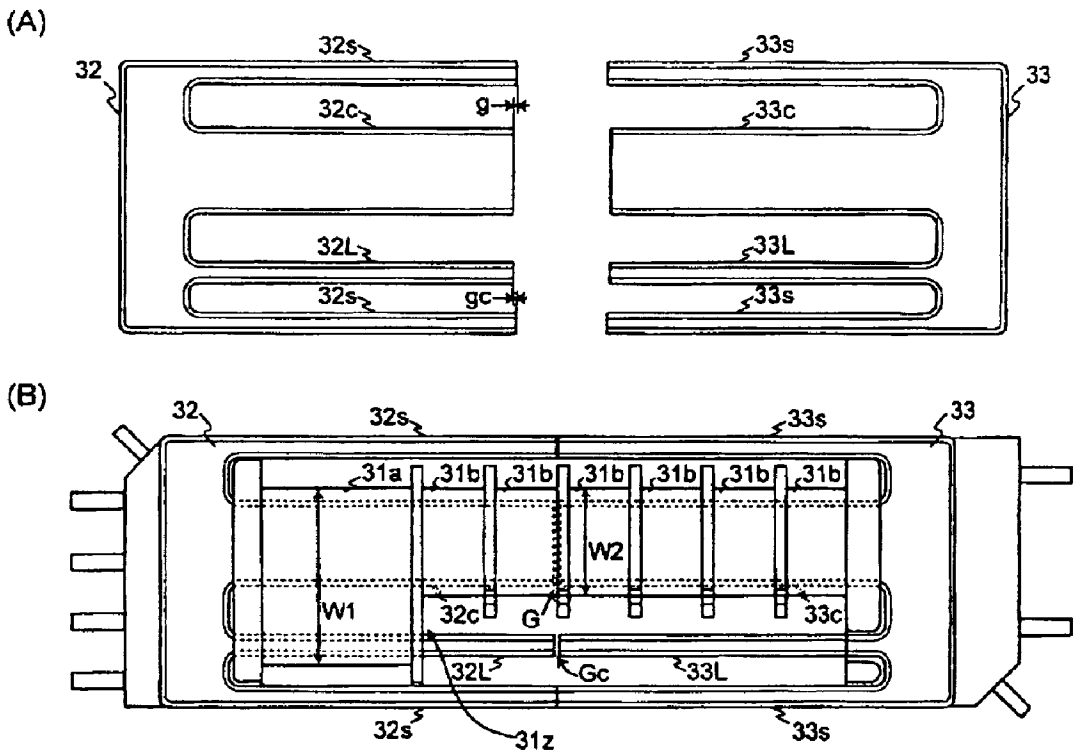
FIG. 5 is a diagram showing the core configuration and the positional relationship between a support member, cores, etc. in Embodiment 3.

FIG. 5 is a diagram showing the configurations of the cores 32 and 33 and the positional relationship between the support member 31, the cores 32 and 33, etc. in Embodiment 3. FIG. 5(A) is a plan view of the cores 32 and 33, and FIG. 5(B) is a plan view of the leakage transformer of Embodiment 3.

As shown in FIG. 5(A), in Embodiment 3, the cores 32 and 33 have the same configuration. Each of the cores 32 and 33 has inner extending parts 32*c* and 33*c* for magnetic coupling, inner extending parts 32L and 33L for leakage, and pairs of extending parts 32*s* and 33*s* on the outer sides. The four extending parts 32*c* and 32L, and 32*s* extend in the same direction, and are formed integrally as one core 32. Similarly, the four extending parts 33*c*, 33L, and 33*s* extend in the same direction and are formed integrally as a single core 33. The sectional area of the extending part 32*c* (33*c*) (sectional area taken in a direction perpendicular to the extending direction) is designed to be larger than the sectional area of the other extending parts 32L and 32*s* (33L and 33*c*).

Further, the extending part 32*c* (33*c*) is formed to be shorter than the two outer extending parts 32*s* (33*s*) by a length g. As a result, as shown in FIG. 5(B), when the distal end of the extending part 32*s* of the core 32 and the distal end of the extending part 33*s* of the core 33 are caused to abut each other, there is formed a gap (clearance) G of a length 2*g* between the extending part 32*c* of the core 32 and the extending part 33*c* of the core 33.

Further, the extending part 32L (33L) is formed to be shorter than the outer two extending parts 32*s* (33*s*) by a length gc. As a result, as shown in FIG. 5(B), when the distal ends of the extending parts 32*s* of the core 32 and the distal ends of the extending parts 33*s* of the core 33 are caused to abut each other, a gap (clearance) Gc having a length of 2*g* is formed between the extending part 32L of the core 32 and the extending part 33L of the core 33.

On the other hand, as in Embodiment 1, the primary winding and the secondary winding are respectively wound around the bobbin portions 31*a* and the bobbin portions 31*b*. That is, the primary winding is wound around the extending part 32*c* and the extending part 32L of the core 32, and the secondary winding is wound around the extending part 32*c* of the core 32 and the extending part 33*c* of the core 33. The coil sectional area of the primary winding is the product of the width W1 of the bobbin portion 31*a* and the height ha of the bobbin portion 31*a*, and the coil sectional area of the secondary winding is the product of the width W2 of the bobbin portion 31*b* and the height hb of the bobbin portions 1*b*. The coil sectional area of the primary winding is designed to be larger than the coil sectional area of the secondary winding. In Embodiment 3, the heights ha and hb of the bobbin portions 31*a* and 31*b* are substantially the same, and the width W1 of the bobbin portion 31*a* is designed to be larger than the width W2 of the bobbin portions 31*b*, so the coil sectional area of the primary winding is larger than the coil sectional area of the secondary winding.

Further, in Embodiment 3, while the extending part 32*c* and the extending part 32L extend through the coil section of the primary winding wound around the bobbin portion 31*a*, the coil section of the secondary winding wound around the bobbin portions 31*b* is penetrated solely by the extending parts 32*c* and 33*c* and not by the extending part 32L.

Next, the magnetic characteristics of the above-mentioned leakage transformer will be illustrated.

The extending parts 32*c* and 33*c* of the two cores 32 and 33 form a center core part extending linearly through the primary winding and the secondary winding wound around the bobbins 31*a* and 31*b*, respectively. This center core part is provided with the gap G. The extending parts 32L and 33L of the two cores 32 and 33 form a leakage core part extending solely through the primary winding of the primary winding and the secondary winding. Further, the two outer extending parts 32*s* and 33*s* of the two cores 32 and 33 form a peripheral core part constituting the external magnetic path of the primary winding and the secondary winding. That is, the boundaries between the center core part, the leakage core part, and the peripheral core part are within the cores 32 and 33, with those cores being continuous without the presence of any bonding portion or gap.

In Embodiment 3, the center core part, the leakage core part, and the two peripheral core parts form a circuiting magnetic path (a magnetic path including the gaps G and Gc).

In this magnetic construction, most of the magnetic fluxes generated by the primary winding circuit through the center core part (extending parts 32*c* and 33*c*) and the peripheral core parts (extending parts 32*s* and 33*s*) to undergo interlinkage with the secondary winding.

On the other hand, among the magnetic fluxes generated by the primary winding, there exists a first leakage magnetic flux passing through a part or all of the leakage core parts (extending parts 32L and 33L) and not undergoing interlinkage with the secondary winding. Further, among the magnetic fluxes generated by the primary winding, there also exists a second leakage magnetic flux leaking through the gap G and circuiting without undergoing interlinkage with a part of the secondary winding.

In the leakage transformer of Embodiment 3, there is formed by the leakage core part a magnetic path not undergoing interlinkage with secondary winding, so the leakage magnetic flux amount increases, making it possible to attain a sufficiently high leakage inductance value. In addition, the first and second leakage magnetic fluxes easily pass through the outer extending parts 32*s* and 33*s* of the cores 32 and 33, respectively, so the amount of magnetic flux leakage to the exterior of the transformer is advantageously small.

Further, the gap Gc exists in this leakage core part; by adjusting the length of the gap Gc, it is possible to easily adjust the leakage magnetic flux amount. The adjustment of the length of the gap Gc can be realized by adjusting the length of the extending parts 32L and 33L of the cores 32 and 33.

Figure 6:
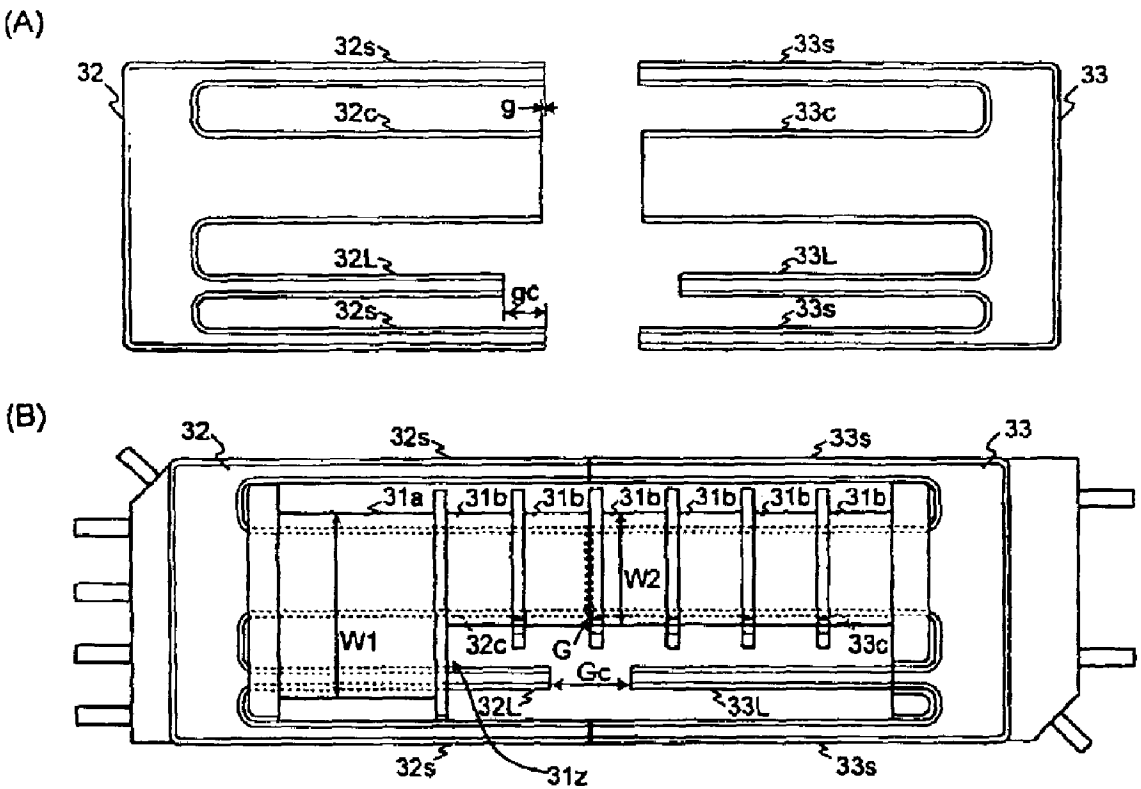
FIG. 6 is a diagram showing the core configuration in a case in which a leakage amount adjustment gap is elongated in Embodiment 3.

FIG. 6 is a diagram showing the configuration of the cores 32 and 33 when in Embodiment 3 the gap Gc for leakage amount adjustment is elongated. As compared with the cores 32 and 33 shown in FIG. 5, in the cores 32 and 33 shown in FIG. 6, the extending parts 32L and 33L are shorter. Thus, the gap Gc of the leakage core part is longer, so, as compared with the case of FIG. 5, the leakage magnetic flux passing through the leakage core part of FIG. 6 is smaller.

As described above, the above-mentioned leakage transformer of Embodiment 3 is equipped with a leakage core part passing solely through the primary winding of the primary winding and the secondary winding. With this construction, it is possible to secure a sufficient leakage inductance by making the coil sectional area of the primary winding larger than the coil sectional area of the secondary winding while reducing the magnetic flux leakage to the exterior by means of the outermost two extending parts 32*s* and 33*s* of the cores 32 and 33.

Further, according to Embodiment 3 described above, by adjusting the gap Gc of the leakage core part, it is possible to easily adjust the leakage magnetic flux amount (that is, leakage inductance value) without changing the configuration of the other portions of the cores 32 and 33.

Embodiment 4

A leakage transformer according to Embodiment 4 of the present invention has on the top portion of the leakage transformer of Embodiment 1 an upper surface core, which is connected to the upper surfaces of the cores 2 and 3 and which covers the primary winding 4 and the secondary winding 5.

Figure 7:
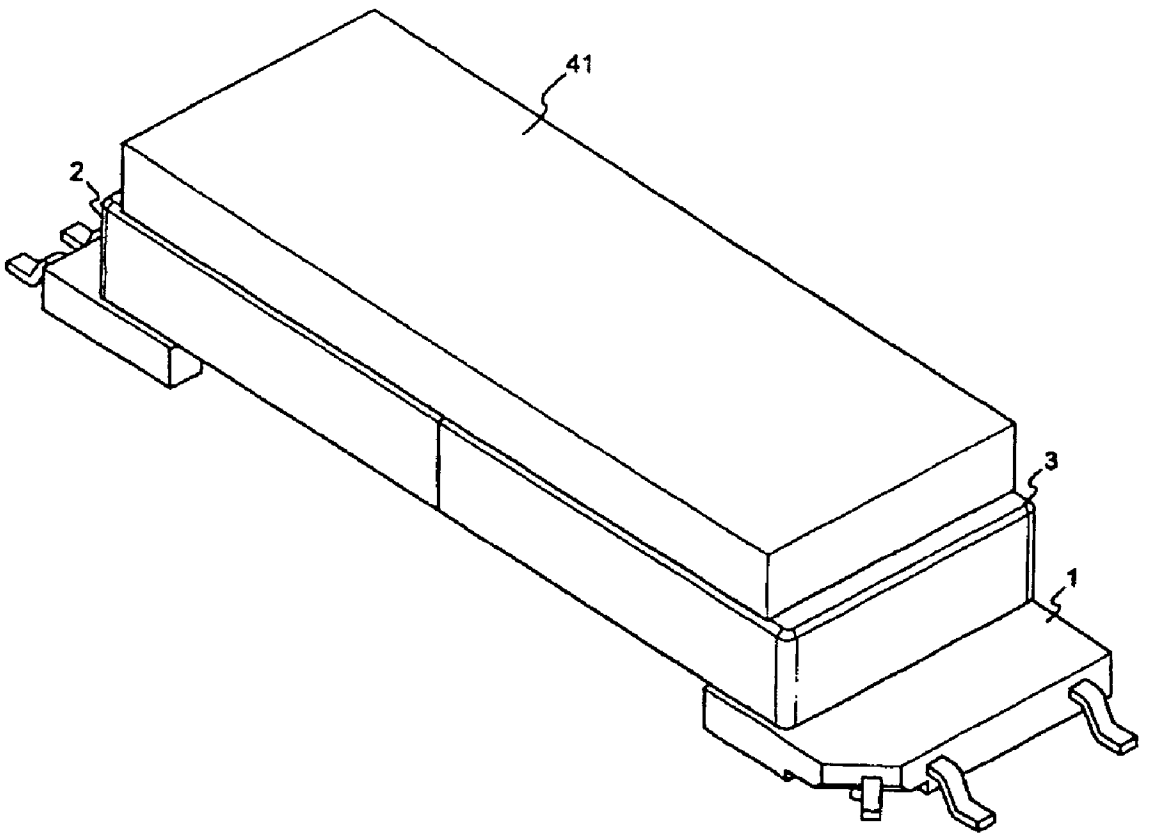
FIG. 7 is a perspective view of a leakage transformer according to Embodiment 4 of the present invention.

FIG. 7 is a perspective view of a leakage transformer according to Embodiment 4 of the present invention. In FIG. 7, an upper surface core 41 is a flat core which is formed of a magnetic material such as ferrite, which is connected to the upper surfaces of the cores 2 and 3, and which covers the primary winding 4 and the secondary winding 5.

Figure 8:
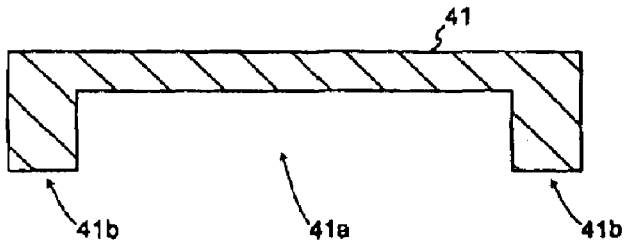
FIG. 8 is a sectional view of an upper surface core in Embodiment 4.

FIG. 8 is a sectional view of the upper surface core 41 of Embodiment 4. Outwardly, the upper surface core 41 is formed as a parallelepiped having a recess 41*a* in one surface thereof. The recess 41*a* is provided for the purpose of preventing interference of the upper surface core 41 with the bobbin portions 1*a* and 1*b*, etc. In the periphery of the recess 41*a*, there is formed a bonding surface 41*b* to be bonded to the cores 2 and 3. The bonding surface 41*b* is bonded to the upper surfaces of the cores 2 and 3. The surface of the upper surface core 41 on the opposite side of the recess 41*a* is formed as a flat surface free from surface irregularities.

Otherwise, the leakage transformer of Embodiment 4 is of the same construction as that of Embodiment 1, so a description thereof will be omitted. While in Embodiment 4 the upper surface core 41 is added to the leakage transformer of Embodiment 1, it is also possible to add the upper surface core 41 to the leakage transformers of Embodiments 2 and 3.

As described above, according to Embodiment 4 described above, the upper surface core 41 is connected to the upper surfaces of the cores 2 and 3, and covers the primary winding and the secondary winding. With this construction, it is possible to secure a sufficient leakage inductance while further reducing the magnetic flux leakage to the exterior by means of the upper surface core 41 in addition to the outer two extending parts 2*s* and 3*s*.

Further, when placing the leakage transformer on a board by means of a mounting machine, the upper surface core is caused to be attracted to the mounting machine, whereby its placing on the board is made possible without using any separate member for attraction. The mounting machine attracts the leakage transformer from above (i.e., from the upper surface side of the leakage transformer when the leakage transformer is placed on the board) to convey the leakage transformer onto the board. The upper surface of the upper surface core 41 is formed as a flat surface, which can be easily attracted by the mounting machine. Thus, it is possible to place the leakage transformer on the board without using any separate member for attraction (e.g., Kapton tape attached to the upper surface of a leakage transformer having no upper surface core 41).

Embodiment 5

A leakage transformer according to Embodiment 5 of the present invention has cutouts in the bonding surfaces of the cores 2 and 3 of the leakage transformer of Embodiment 1.

Figure 9:
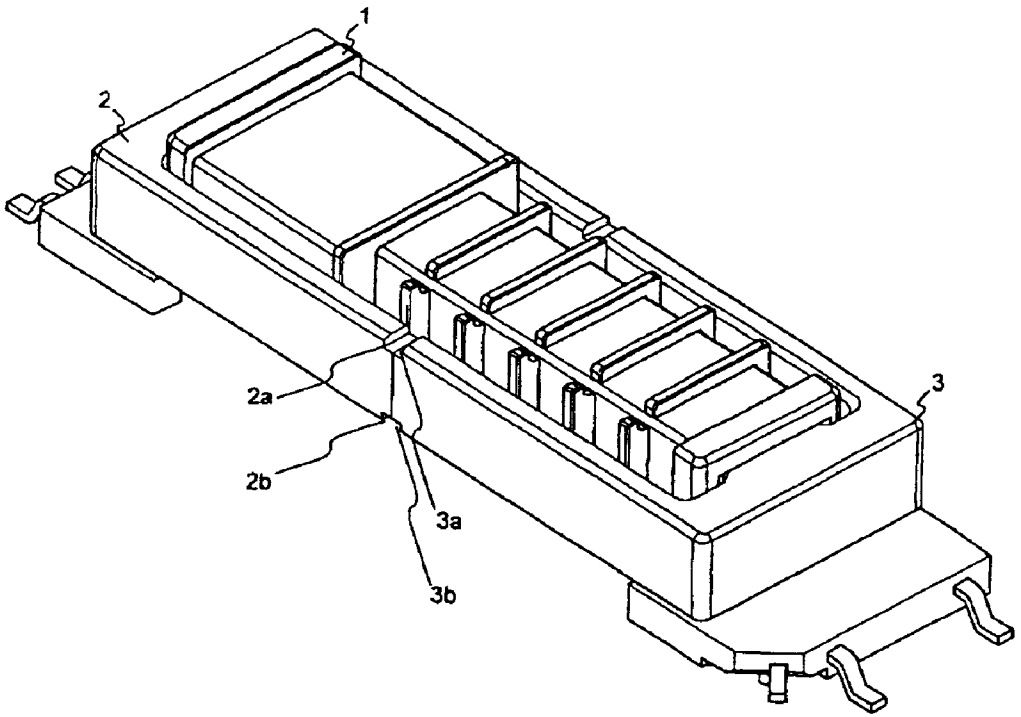
FIG. 9 is a perspective view of a leakage transformer according to Embodiment 5 of the present invention.

FIG. 9 is a perspective view of the leakage transformer of Embodiment 5 of the present invention. In FIG. 9, a cutout 2*a* is a cutout formed on the upper surface side of the distal end of the extending part 2*s* of the core 2, and a cutout 2*b* is a cutout formed on the lower surface side of the distal end of the extending part 2*s* of the core 2. A cutout 3*a* is a cutout formed on the upper surface side of the distal end of the extending part 3*s* of the core 3, and a cutout 3*b* is a cutout formed on the lower surface side of the distal end of the extending part 3*s* of the core 3. All the cutouts 2*a*, 2*b*, 3*a*, and 3*b* of FIG. 9 have a step-like configuration. The depth of the cutouts 2*a*, 2*b*, 3*a*, and 3*b* as measured from the upper surfaces or the lower surfaces of the cores 2 and 3 is approximately 1 mm when the height of the leakage transformer is approximately 3 to 4 mm. In Embodiment 5, the cutout portions at the bonding portion between the core 2 and the core 3 are formed by the cutout 2*a* and the cutout 3*a* and by the cutout 2*b* and the cutout 3*b*.

Figure 10:
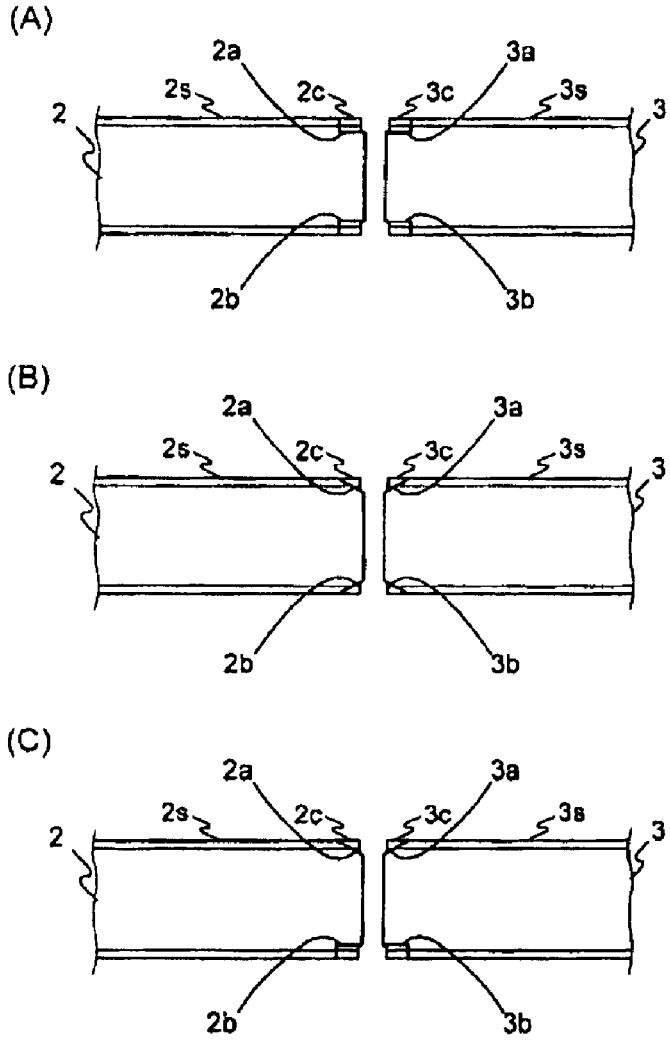
FIG. 10 is a diagram showing an example of cutouts formed in the cores of Embodiment 5.

FIG. 10 shows the examples of the cutouts formed in the cores of Embodiment 5. While the configuration of the cutouts 2*a*, 2*b*, 3*a*, and 3*b* of FIG. 9 is a step-like one as shown in FIG. 10(A), the configuration may also be a slope-like one as shown in FIG. 10(B). Further, as shown in FIG. 10(C), it is also possible to form one of the cutouts 2*a* and 3*b* on the upper surface side and the cutouts 2*b* and 3*b* on the lower surface side in a step-like configuration and the other in a slope-like configuration. Further, it is also possible to form the cutouts 2*a* and 3*a* on the upper surface side solely in one of the core 2 and the core 3, or to form the cutouts 2*b* and 3*b* on the lower surface side solely in one of the core 2 and the core 3. In Embodiment 5, also by adopting those constructions, it is possible to form cutout portions in the bonding portion between the core 2 and the core 3.

In Embodiment 5, the cutouts 2*a*, 2*b*, 3*a*, and 3*b* are formed solely at the distal ends of the extending parts 2*s* and 3*s* bonded to each other, and no cutouts are formed in the extending parts 2*c* and 3*c*, which are not bonded to each other but form a gap.

Otherwise, the leakage transformer of Embodiment 5 is of the same construction as that of Embodiment 1, so a description thereof will be omitted. While in Embodiment 5 the cutouts 2*a*, 2*b*, 3*a*, and 3*b* are added to the leakage transformer of Embodiment 1 described above, it is also possible to add similar cutouts to the extending parts 2*s*, 3*s*, 12*s*, 32*s*, and 33*s* of the leakage transformers of Embodiments 2, 3, and 4 described above.

As described above, according to Embodiment 5 described above, the outermost two extending parts 2*s* and 3*s* of the core 2 and the core 3 form cutout portions in the bonding portion between the core 2 and the core 3. As a result, the cutout portions constitute adhesive accumulating places when bonding the core 2 and the core 3 to each other, making it possible to retain surplus adhesive squeezed out of the bonding portion.

The present invention is not restricted to the above-mentioned preferred embodiments but allows various modifications and changes without departing from the gist of the present invention.

For example, while in the above-mentioned embodiments the bobbin portions 1*a*, 1*b*, 31*a*, and 31*b* of the primary winding and the secondary winding are formed as box-shaped tube, they may also be formed as cylinders.

Further, while in the above-mentioned embodiments the number of extending parts of each core 2, 3, 12, 32, and 33 is three or four, it may also be five or more.

Further, while in Embodiments 1, 3, and 4 described above the two cores 2 and 3 (32 and 33) are of the same configuration, it is also possible to make the lengths of all the extending parts of one core the same and to make the length of the extending parts other than the outer two extending parts of the other core smaller than the length of the outer two extending parts to form the gap G.

Further, while in the above-mentioned embodiments there are generated the first leakage magnetic flux attributable to the fact that the coil sectional area of the primary winding is larger than the coil sectional area of the secondary winding and the second leakage magnetic flux attributable to the gap G of the center core part, it is also possible to provide no gap G when a sufficient inductance can be realized solely by the first leakage magnetic flux.

Further, in each of the above-mentioned embodiments the primary winding and a part of the secondary winding are wound around the core 2, 12, and 32 on the primary side and solely the secondary winding is wound around the core 3 and 33 on the secondary side, it is also possible to adopt a construction in which solely the primary winding is wound around the core 2, 12, and 32 on the primary side and in which solely the secondary winding is wound around the core 3 and 33 on the secondary side. Further, it is also possible to adopt a construction in which the primary winding and the secondary winding are wound solely around one core 2, 12, and 32 or a construction in which the primary winding and the secondary winding are wound solely around one core 3 and 33.

Further, while the above-mentioned embodiments employ ferrite as an example of the material of the cores, it is also possible to employ permalloy, sendust, dust core, etc.

Further, while in the above-mentioned embodiments the core portion is formed by two E-shaped cores, it is also possible to form a core portion of a similar configuration by an E-shaped core and an I-shaped core or by an O-shaped core and an I-shaped core.

INDUSTRIAL APPLICABILITY

The present invention is applicable, for example, to the inverter transformer of the backlight drive circuit of a liquid crystal display.

The invention claimed is:

1. A leakage transformer, comprising:

a primary winding;

a secondary winding wound at a part on an extension of a winding part of the primary winding separately from the primary winding and having a coil sectional area smaller than that of the primary winding;

a first core and a second core each having a center core part formed linearly, a peripheral core part forming a magnetic path on the outer side of the primary winding and the secondary winding, the primary winding being wound around the center core part of at least one of the first core and the second core, the secondary winding being wound around the center core part of at least one of the first core and the second core; and a leakage core part formed in parallel with the center core part and extending through only the primary winding.

2. A leakage transformer according to claim 1, wherein an air gap is disposed between the leakage core part of the first core and the leakage core part of the second core.

3. A leakage transformer according to claim 1, further comprising an upper surface core connected to the upper surfaces of the first core and the second core and covering the primary winding and the secondary winding.

4. A leakage transformer according to claim 1, wherein the peripheral core part of each of the first core and the second core have cutout portions at a bonding portion between the first core and the second core.

* * * * *